US009505120B2

(12) United States Patent
Aoki et al.

(10) Patent No.: US 9,505,120 B2
(45) Date of Patent: Nov. 29, 2016

(54) POWER TOOL

(71) Applicant: HITACHI KOKI CO., LTD., Tokyo (JP)

(72) Inventors: Yoshiki Aoki, Ibaraki (JP); Masato Sakai, Ibaraki (JP); Masanori Okada, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 461 days.

(21) Appl. No.: 14/104,631

(22) Filed: Dec. 12, 2013

(65) Prior Publication Data

US 2014/0174778 A1 Jun. 26, 2014

(30) Foreign Application Priority Data

Dec. 26, 2012 (JP) ..... 2012-283749

(51) Int. Cl.
*B25F 5/02* (2006.01)
*B25F 5/00* (2006.01)
*B25D 17/04* (2006.01)

(52) U.S. Cl.
CPC ..... *B25F 5/02* (2013.01); *B25D 17/04* (2013.01); *B25F 5/006* (2013.01)

(58) Field of Classification Search
CPC ..... B25F 5/00; B25F 5/001; B25F 5/006; B25F 5/02; B25B 21/00
USPC ..... 173/162.1, 162.2, 217, 169, 170; 16/421, 430, 431, 435; 81/177.1, 436, 81/470; D8/68, 62, 67, 70
See application file for complete search history.

(56) References Cited

U.S. PATENT DOCUMENTS 4,879,847 A * 11/1989 Butzen ..... B25F 5/006 173/162.2
5,353,474 A * 10/1994 Good ..... B25F 5/006 16/421
6,161,256 A * 12/2000 Quiring ..... B25F 5/006 16/421
D484,385 S * 12/2003 Sakai ..... D8/68
6,805,207 B2 * 10/2004 Hagan ..... B25B 21/00 173/162.1
D499,945 S * 12/2004 Sugawara ..... D8/68
D520,832 S * 5/2006 Ozawa ..... D8/68

(Continued)

FOREIGN PATENT DOCUMENTS

EP 2 221 150 A1 8/2010
JP 2-228691 A 9/1990

(Continued)

OTHER PUBLICATIONS

Japanese Office Action for the related Japanese Patent Application No. 2012-283749 dated Apr. 26, 2016.

*Primary Examiner* — Scott A. Smith
(74) *Attorney, Agent, or Firm* — Kenealy & Vaidya LLP

(57) ABSTRACT

A power tool includes a housing including: a body part having a substantially cylindrical shape and extends in a front-rear direction; and a handle part connected to the body part. The body part includes: a driving source; a power transmission mechanism part configured to transmit a driving force of the driving source; and a tip tool holding part to which the driving force of the driving source is transmitted from the power transmission mechanism part. The handle part includes a switch. A top part protruding from a surface of the handle part is formed on a side surface of the handle part along a longitudinal direction of the handle part. At least a portion of the top part is arranged at a position deviating rearwards from a center of the handle part in the front-rear direction.

4 Claims, 14 Drawing Sheets

(56) References Cited

U.S. PATENT DOCUMENTS

| | | | | |
|---|---|---|---|---|
| D524,136 | S * | 7/2006 | Taniguchi | D8/68 |
| 7,140,451 | B2 * | 11/2006 | Yoshimizu | G09F 3/02 173/162.2 |
| D605,490 | S * | 12/2009 | Aglassinger | D8/68 |
| D626,394 | S * | 11/2010 | Lopano | D8/68 |
| 8,267,192 | B2 * | 9/2012 | Lopano | B25F 5/02 173/168 |
| 2003/0074766 | A1 * | 4/2003 | Tillim | A61B 17/2909 16/430 |
| 2004/0111933 | A1 * | 6/2004 | Yoshimizu | G09F 3/02 40/299.01 |
| 2005/0121209 | A1 * | 6/2005 | Shimizu | B25F 5/02 173/217 |
| 2005/0155778 | A1 | 7/2005 | Ishida et al. | |
| 2005/0257944 | A1 * | 11/2005 | Cooper | B25F 5/006 173/217 |
| 2006/0075605 | A1 * | 4/2006 | Lagaly | B25F 5/02 16/430 |
| 2006/0175069 | A1 * | 8/2006 | Sakakibara | B25F 5/02 173/217 |
| 2010/0050830 | A1 | 3/2010 | Hachisuka | |
| 2011/0227430 | A1 | 9/2011 | Omori et al. | |

FOREIGN PATENT DOCUMENTS

| | | | |
|---|---|---|---|
| JP | 2005-199406 | A | 7/2005 |
| JP | 2008-44024 | A | 2/2008 |
| JP | 2008-62347 | A | 3/2008 |
| JP | 2010-58211 | A | 3/2010 |
| JP | 2010-99823 | A | 5/2010 |

* cited by examiner

POWER TOOL

CROSS-REFERENCE TO RELATED APPLICATIONS

This application claims priority from Japanese Patent Application No. 2012-283749 filed on Dec. 26, 2012, the entire subject-matter of which is incorporated herein by reference.

TECHNICAL FIELD

The invention relates to a portable power tool including a housing having a body part and a handle part connected to the body part, and more particularly, to a power tool that can be easily gripped by improving a shape of the handle part.

BACKGROUND

A portable power tool such as an impact driver includes a housing including a body part having a substantially cylindrical shape and extending back and forth and a handle part connected to the body part so as to form a substantial T shape, when seen from the side. The body part accommodates therein a driving source such as a motor and the like, a power transmission mechanism part that transmits a driving force of the driving source and a tip tool holding part to which the driving force of the driving source is transmitted from the power transmission mechanism part. The handle part includes a switch for controlling the driving source. Such an impact driver is disclosed in JP-A-2008-62347 and JP-A-2010-99823. Here, the related-art impact driver, which is an example of the power tool, will be described on the basis of FIGS. 13 to 15. Incidentally, FIG. 13 is a left side view of the related-art impact driver, and FIG. 14 is a right side view of the related-art impact driver.

In FIGS. 13 and 14, an impact driver 101 has a housing 102, which is an outer frame forming an outward shape, and a hammer case 103 that is mounted at a front of the housing. The housing 102 is configured by a substantially cylindrical body part 102*a* extending back and forth, a handle part 102*b* connected to the body part 102*a* such that it forms a substantial T shape, when seen from the side, and a battery attaching part 102*c* that is formed to expand at the lower of the handle part 102*b*. A trigger 106 for starting a motor and adjusting a rotating speed of the motor and a changeover lever 108 for switching a rotating direction of the motor are provided above the handle part 102*b* of the housing 102 and just below the body part 102*a*. A battery 140 such as a nickel cadmium battery and a lithium ion battery is detachably mounted to a lower side of the housing 102. A side of the body part 102*a* of the housing 102 is provided with an air introduction port 111 for introducing air for motor cooling and air discharge ports 112*a*, 112*b* for discharging the inside air.

FIG. 15 is a longitudinal sectional view showing an internal structure of the impact driver 101 of the related art. In the body part 102*a* of the housing 102, a motor 105 that is the driving source, a planetary gear mechanism 120 configured to decelerate a rotation output of the motor 105 and a striking mechanism part 121 configured to convert a rotating force of the motor 105 decelerated by the planetary gear mechanism 120 into a rotating striking force and to transmit the rotating striking force to an output shaft 130 for holding a tip tool are accommodated. The handle part 102*b* of the housing 102 is provided with the switch 107 and the trigger 106 for operating the switch 107 is provided such that it is exposed to the outside beyond the housing 102. The battery 140 is mounted to the battery attaching part 102*c* of the housing 102. The changeover lever 108 can be transversely moved and selectively protrudes from a left or right surface of the body part 102*a*. When an operator pushes the protruding part of the changeover lever 108 and protrudes the lever from the other end-side, the rotating direction of the motor 105 can be switched between a positive direction (e.g., an engaging direction) and a reverse direction (e.g., a disengaging direction).

With the impact driver 101, when the operator turns on the trigger 106 to thereby start the motor 105, the rotating force of the output shaft 112 of the motor 105 is decelerated by the planetary gear mechanism (deceleration mechanism) 120 and is then transmitted to a spindle 127, so that the spindle 127 is rotated at predetermined speed. Here, the spindle 127 and a hammer 124 are connected to each other by a cam mechanism. The cam mechanism includes a V-shaped spindle cam groove 125 formed on an outer periphery of the spindle 127, a V-shaped hammer cam groove 128 formed on an inner periphery of the hammer 124 and a ball 126 that is engaged with the cam grooves 125, 128. The hammer 124 is always urged in a tip direction (a forward direction) by a spring 123, and in a non-operation state, the hammer 124 is spaced apart at an interval from an end face of an anvil 129 by engagement of the ball 126 and the cam grooves 125, 128. Convex portions are symmetrically formed at two positions on rotary surfaces on which the hammer 124 and the anvil 129 are opposed to each other, respectively. Incidentally, the anvil 129 is integrally formed with the output shaft 130 configured to detachably hold a bit (not shown), which is the tip tool, and a tip of the output shaft 130 is formed with a bit mounting hole (a tip tool holding part) 130*a* having an axially perpendicular hexagonal section.

Incidentally, when the spindle 127 is rotated at the predetermined speed, as described above, the rotation of the spindle 127 is transmitted to the hammer 124 through the cam mechanism and the convex portion of the hammer 124 is engaged with the convex portion of the anvil 129 to thus rotate the anvil 124 while the hammer 124 does not make a half turn. However, at this time, when a relative rotation is caused between the hammer 124 and the spring 123 by an engaging reactive force, the hammer 124 starts to retreat towards the motor 105 while compressing the spring 123 along the spindle cam groove 125 of the cam mechanism.

When the hammer 124 retreats and the convex portion of the hammer 124 goes over the convex portion of the anvil 129 and the engaged state therebetween is thus released, the hammer 124 is moved forwards by the urging force of the spring 123 while being rapidly accelerated in the rotating direction and in the forward direction by virtue of the rotating force of the spindle 127 and action of the elastic energy accumulated to the spring 123 and the cam mechanism, and the convex portion of the hammer 124 is again engaged with the convex portion of the anvil 129, so that they are integrally rotated. At this time, since the strong rotating striking force is applied to the anvil 129, the rotating striking force is transmitted to a screw (not shown) through the bit mounted to the anvil 129. After that, the same operation is repeated, so that the rotating striking force is intermittently transmitted to the screw from the bit and the screw is thus screwed into a material to be engaged (not shown) such as wood and the like.

Incidentally, according to the impact driver 101, the operator performs the operation while turning on/off the trigger 106 by using an index finger with gripping the handle part 102*b* of the housing 102. In order to prevent the operator's finger gripping the handle part 102*b* from sliding or to make better a gripping feeling to thereby improve the operability and workability, a surface of the housing 102 is formed with a soft layer consisting of elastomer and the like softer than a hard layer configuring a main body part of the housing 102. Also, a tip of the body part 102*a* of the housing 102 is attached with a protector 104 consisting of soft elastomer and the like, which prevents a damage of a member to be engaged such as a building material and also prevents the impact driver 101 from sliding when it is put on an inclined surface. Also, a part of the handle part (grip part) 102*b*, which is gripped by the operator, is provided with a sliding prevention mechanism such as convex surface such that the operator can always comfortably grip the same.

SUMMARY

Regarding the power tool, a grip shape conforming to the concave and convex of the palm has been suggested so as to increase a sense of fitting when the operator grips the power tool. However, when the sense of fitting is laid stress on, the optimal gripping position is limited, so that the optimal sense of gripping is not provided in some cases when the operator takes a gripping method matched to the operator's habits or operating situations. As shown in FIGS. 13 and 14, the handle part 102*b* of JP-A-2008-62347 is formed with convex shapes 118*a*, 118*b* that are added to a middle part of the side thereof in conformity to the concave and convex of the palm. Since the handle part 102*b* is bilaterally symmetrically formed such that it can be used with both the right hand and the left hand, the convex shapes 118*a*, 118*b* are added in the bilaterally symmetric shape. However, when the operator grips the handle part 102*b*, tips of the middle finger, the ring finger and the little finger holding the middle part are contacted to the convex shapes 118*a*, 118*b*, so that some operators feel the stress due to the contact. In particular, since the demands for the sense of fitting are totally different at the right and left sides, it is important to widely meet the respective demands of the operators.

Upon the trigger operation, the operator usually pulls the trigger 106 with the index finger. Hence, the handle part 102*b* is usually made such that it is possible to easily perform the trigger operation with the index finger. However, according to the inspection of the inventors, it was found that the trigger operation is unexpectedly performed with the middle finger due to the operator's habit or due to fatigue due to the longtime operation, in many cases. In this case, it is necessary to provide a place on which the first finger is put at a position higher than the trigger 106. However, in many cases, many operators stretch and put the finger to and at the adjacency of the tip of the body part 102*a* so as to more stabilize the main body during the operation. However, according to the impact driver 101 disclosed in JP-A-2008-62347, since the hammer case 103 is exposed at the place on which the first finger is put and the soft layer is not sufficiently arranged thereto, the gripping force is not stable and the hammer case 103 is heated as the power tool is used, so that the operator may feel unpleasant.

Therefore, an object of the invention is to provide a power tool having a handle part that can be easily gripped by an ergonomically optimal shape and that can be easily applied with a force by using a fingertip and thus enables an operator not to be well tired even for a longtime operation.

Another object of the invention is to provide a power tool capable of securely preventing an operator's finger gripping a handle part from sliding during an operation, thereby improving operability and workability.

Still another object of the invention is to provide a power tool configured such that a finger is not slid and is pleasantly held even when the finger is put on a body part of a housing.

The representative features of the invention disclosed in the specification are as follows.

According to one illustrative aspect of the invention, there is provided a power tool comprising: a housing comprising: a body part that has a substantially cylindrical shape and extends in a front-rear direction; and a handle part that is connected to the body part, wherein the body part comprises: a driving source; a power transmission mechanism part configured to transmit a driving force of the driving source; and a tip tool holding part to which the driving force of the driving source is transmitted from the power transmission mechanism part, wherein the handle part comprises a switch, wherein a top part protruding from a surface of the handle part is formed on a side surface of the handle part along a longitudinal direction of the handle part, and wherein at least a portion of the top part is arranged at a position deviating rearwards from a center of the handle part in the front-rear direction.

According thereto, since at least a portion of the top part is arranged at the position deviating rearwards from the center of the handle part in the front-rear direction, the top part is matched with a dent portion of the palm, the gripping is easily made while fingertips of the middle, ring and little fingers are not contacted to the top part, and the finger is prevented from sliding, so that it is possible to implement the handle shape with which an operator is not tired well even during a longtime operation.

According to another illustrative aspect of the invention, there is provided a power tool comprising: a housing comprising: a body part that has a substantially cylindrical shape and extends in a front-rear direction; and a handle part that is connected to the body part, wherein the body part comprises: a driving source; a power transmission mechanism part configured to transmit a driving force of the driving source; and a tip tool holding part to which the driving force of the driving source is transmitted from the power transmission mechanism part, wherein the handle part comprises a switch, wherein the housing is formed by multilayer molding a hard layer of a synthetic resin and a soft layer softer than the hard layer, wherein the hard layer on a side surface of the handle part is formed with a mold line for molding processing, wherein the mold line has a divided portion and is arranged such that an entire shape thereof becomes a substantial W shape, when seen from a side surface, and wherein one or two places of three places of upper, middle and lower portions of the handle part are formed with U-shaped mold lines that are parts of the W shape.

According thereto, since one or two places of three places of the upper, middle and lower portions of the handle part are formed with the U-shaped mold lines that are parts of the W shape, it is possible to effectively use the mold lines, which are formed for molding technology reasons so as to easily separate the elastomer from the mold, for improvements on the easy gripping of the handle part.

According to still another illustrative aspect of the invention, there is provided a power tool comprising: a housing comprising: a body part that has a substantially cylindrical shape and extends in a front-rear direction; and a handle part that is connected to the body part, wherein the body part comprises: a driving source; a power transmission mechanism part configured to transmit a driving force of the driving source; and a tip tool holding part to which the driving force of the driving source is transmitted from the power transmission mechanism part, wherein the handle part comprises a switch, wherein the housing is formed by multilayer molding a hard layer of a synthetic resin and a soft layer softer than the hard layer, wherein a side surface of the body part is formed with a T-shaped mold pattern, when seen from a side surface on which the soft layer is not formed, and wherein an area for displaying a trademark name and a ventilating window for enabling air to pass therethrough inside and outside the housing are formed in an area of the mold pattern.

The above and other objects and novel features of the invention will be clarified from the below descriptions and the drawings.

BRIEF DESCRIPTION OF DRAWINGS

FIGS. 6A to 6C are sectional views of a handle part 2*b* of FIG. 1, in which FIG. 6A is an A-A sectional view of FIG. 1, FIG. 6B is a B-B sectional view of FIG. 1, and FIG. 6C is a C-C sectional view of FIG. 1;

DETAILED DESCRIPTION

First Illustrative Embodiment

Figure 13:
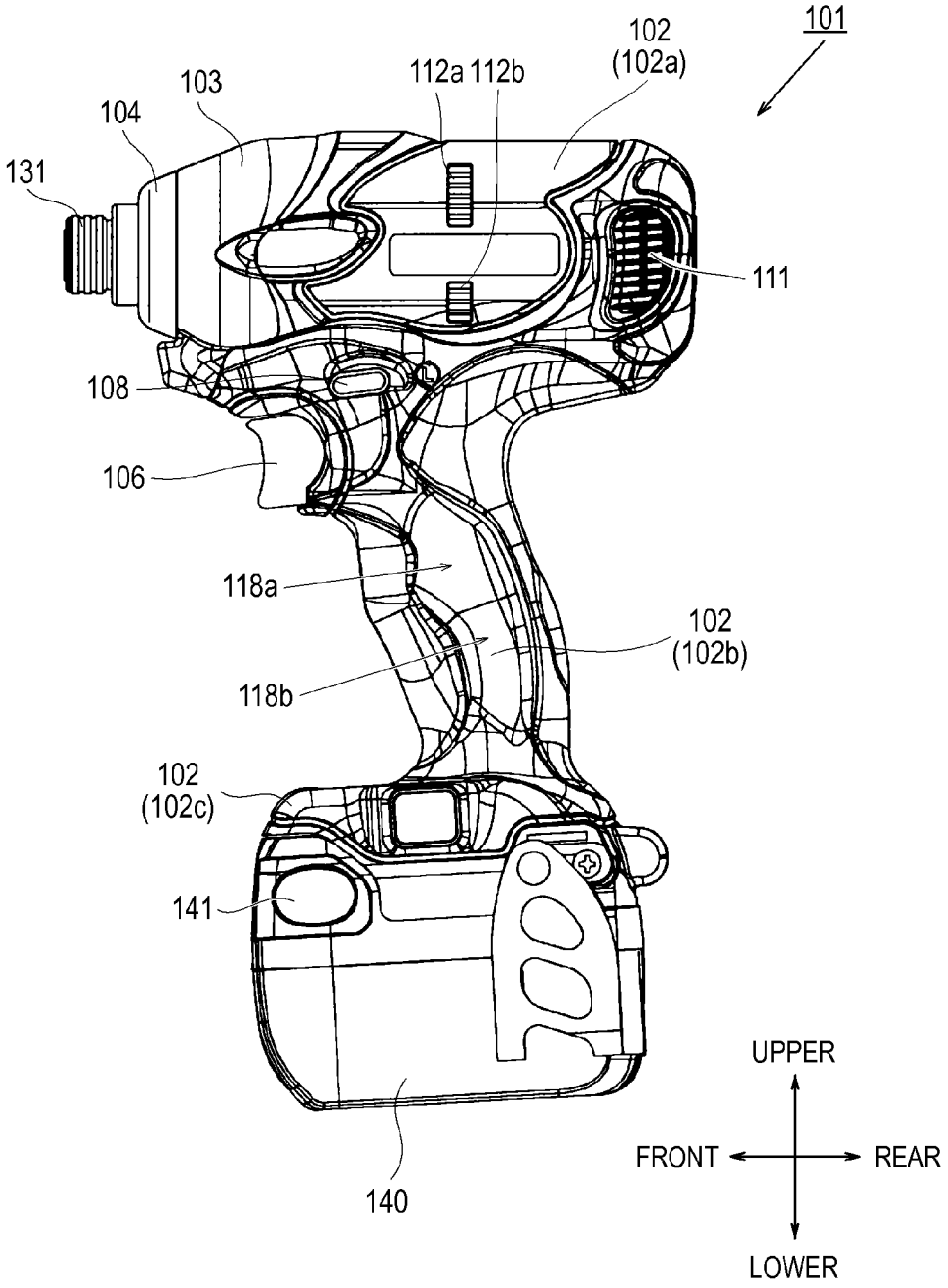
FIG. 13 is a left side view of a related-art impact driver.
Figure 14:
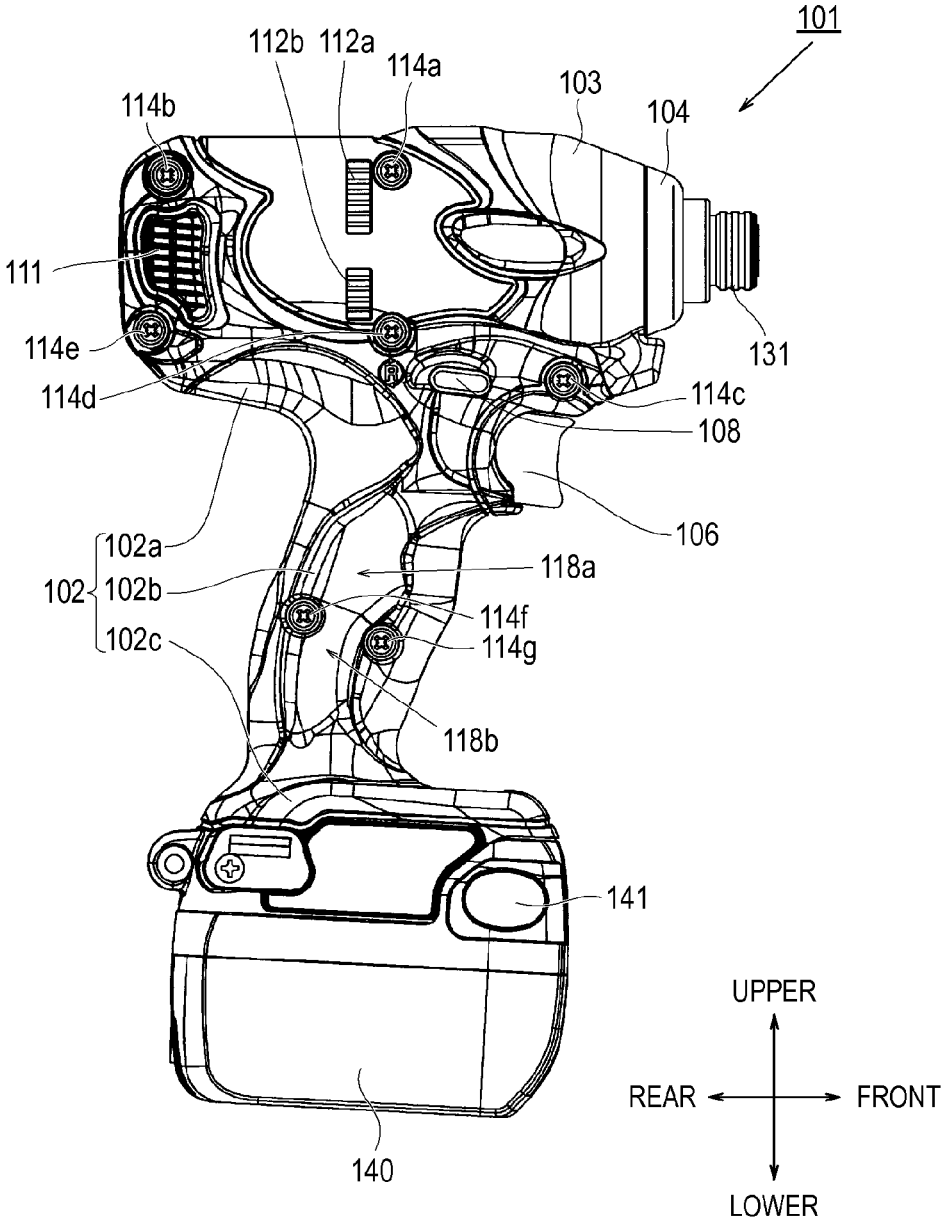
FIG. 14 is a right side view of the related-art impact driver.
Figure 15:
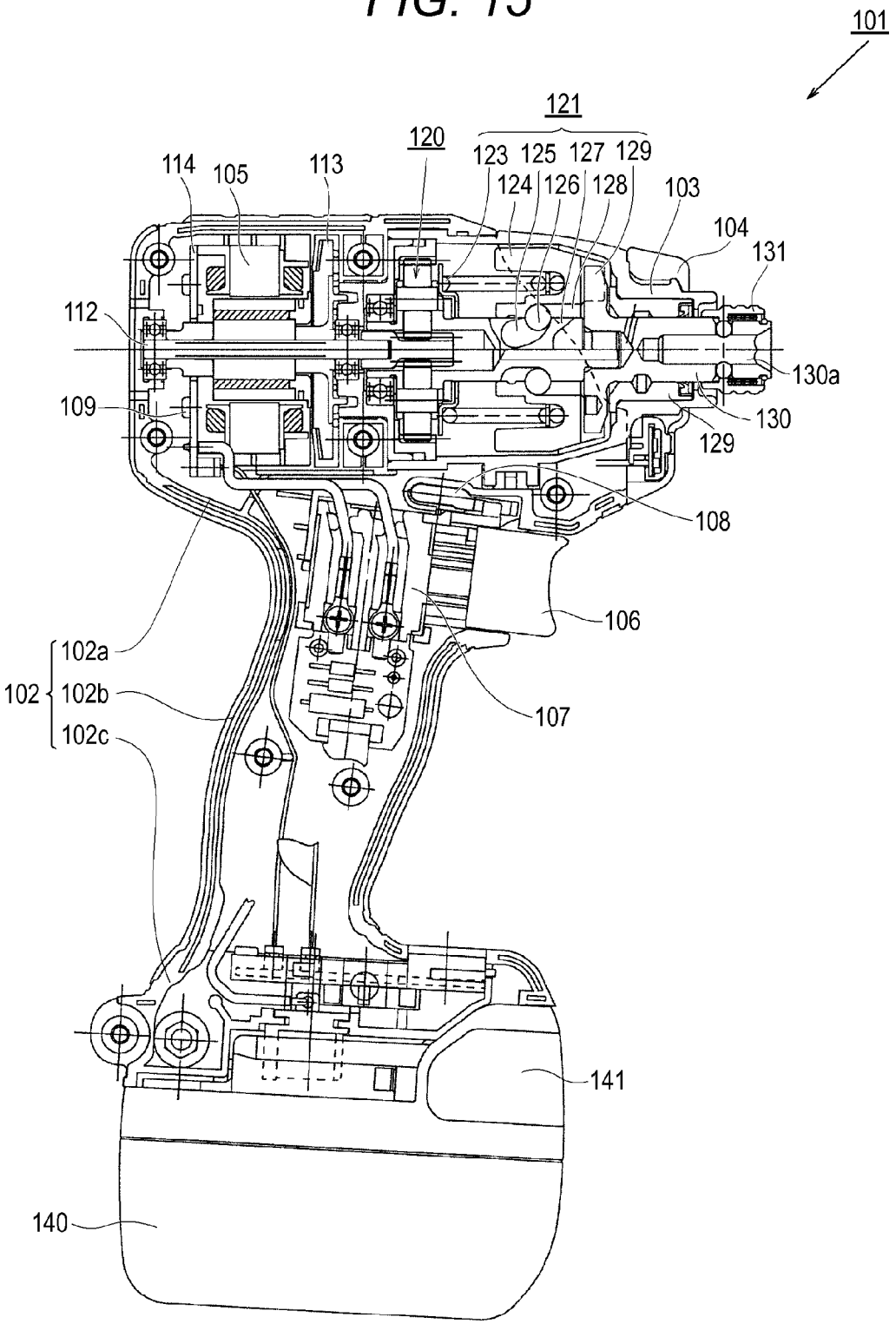
FIG. 15 is a longitudinal sectional view showing an internal structure of the related-art impact driver.

Hereinafter, illustrative embodiments of the invention will be described using an impact driver, which is an example of the power tool, with reference to the drawings. In the specification, the front, rear, left, right, upper and lower directions are described on the basis of the directions shown in the drawings. Also, since the configurations and operations of the devices accommodated in a housing 2 of an impact driver 1 of the invention are the same as those of the impact driver 101 shown in FIGS. 13 to 15, a configuration and an outer shape of the housing will be focused in FIGS. 1 to 12.

Figure 1:
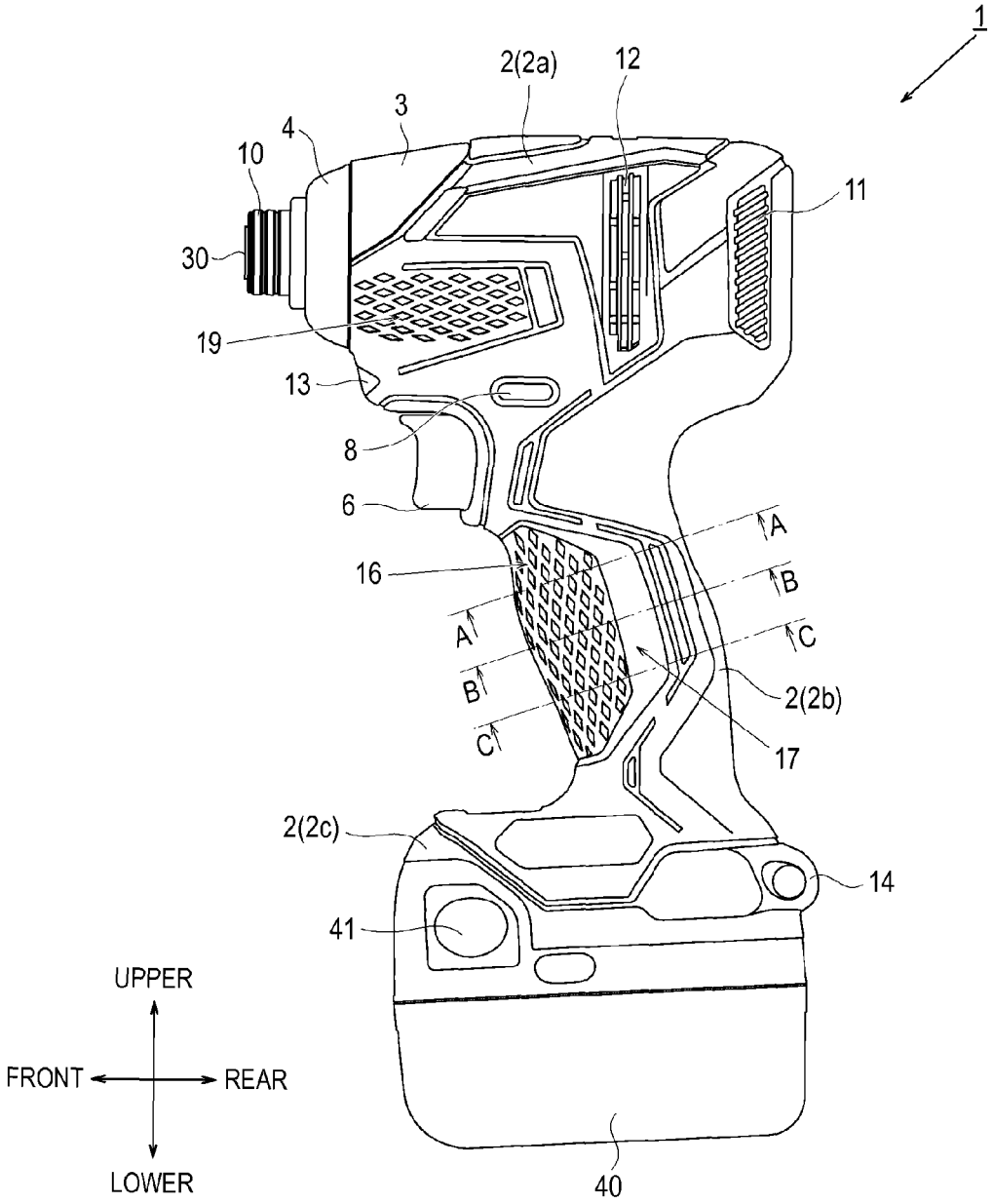
FIG. 1 is a left side view of an impact driver according to an illustrative embodiment of the invention.

As shown in FIG. 1, an outer shape of the impact driver 1 according to this illustrative embodiment is formed by a housing 2, a metallic hammer case 3 that is mounted to a tip-side of a body part 2*a* of the housing 2 and a protector 4 that is formed of a soft material provided at a front-side of the hammer case 3. The housing 2 is manufactured by molding a high molecular resin such as plastic and is formed such that it is divided into two left and right parts by a vertical plane passing through a rotational center axis of the motor, in this illustrative embodiment. Also, a surface of the housing 2 is formed with a soft layer consisting of elastomer and the like, which is softer the hard layer (the high molecular resin such as plastic) configuring the main body part of the housing 2. The soft layer is formed as a thin surface layer having high resiliency on a lower layer, which is the hard layer configuring the housing 2, by a bilayer molding technology. A well-known technology can be used as the manufacturing technology of the bilayer molding. The soft layer is further subject to concave and convex processing for increasing a contact resistance with an operator's finger to make it difficult to slide. The concave and convex processing is performed in conformity to a shape of the soft layer. In the example of FIG. 1, a plurality of rhombus-shaped dent portions is formed in a central front area 16, which is gripped mainly by a middle finger and a ring finger of the operator, and a finger abutting part 19, which becomes a finger placing area on which an index finger of the operator is placed. The hammer case 3 has a substantial cup shape formed by a metallic integral molding. A sectional shape of the hammer case 3 is substantially the same as that shown in FIG. 15. A through-hole, through which an output shaft 30 passes, is formed at a front-bottom part of the hammer case 3. Most of the hammer case 3 is located in the body part 2*a* of the housing 2, so that it cannot be directly contacted from the outside. However, an upper-half area adjacent to the rear of the protector 4 of the hammer case 3 has a triangular shape, when seen from the side shown in FIG. 1. The part of the hammer case, which is exposed to the outside, is subject to polishing processing.

In a space formed by the housing 2 and the hammer case 3, a motor, which is a driving source, and a power transmission mechanism, which is configured to transmit the driving force of the motor, are accommodated. Here, the power transmission mechanism is configured mainly by a planetary gear mechanism and a striking mechanism configured to transmit the driving force of the motor decelerated by the planetary gear mechanism to the output shaft 30, and the power transmission mechanism is substantially the same as that shown in FIG. 15. The body part 2*a* of the housing 2 is formed at a lower side thereof with a handle part 2*b* that extends from a central axis of the body part 2*a* in a substantially vertical direction. A trigger 6 for starting the motor and controlling the rotating speed of the motor and a changeover lever 8 for switching a rotating direction of the motor between a positive direction and a reverse direction are provided in the vicinity of the body part 2*a* and a root of the handle part 2*b*. The trigger 6 is configured such that it can be moved back and forth and is arranged such that the operator can easily operate the trigger 6 with gripping the handle part 2*b*. A tip of the output shaft 30 is provided with a sleeve 10 for attaching and detaching a tip tool (not shown) by one touch operation. When the sleeve 10 is moved forwards relative to the housing 2, the tip tool can be mounted or separated.

A side of the body part 2*a* of the housing 2 is formed with an air introduction port 111 for introducing cooling air for cooling the motor and an air discharge port 12 for discharging the inside air. The ports may be arranged at positions other than the shown positions. The handle part 2*b* of the housing 2 has a substantially cylindrical shape of which a central axis extends in the upper-lower direction and is shaped such that the operator can easily grip the same and does not slide well. A battery 40 of a pack type is mounted to a battery attaching part 2*c* of the housing 2. The battery 40 is detachably mounted. The battery 40 can be detached by pushing release buttons 41, which are provided to both left and right sides, and moving forwards the battery 40 relative to the housing 2.

Figure 2:
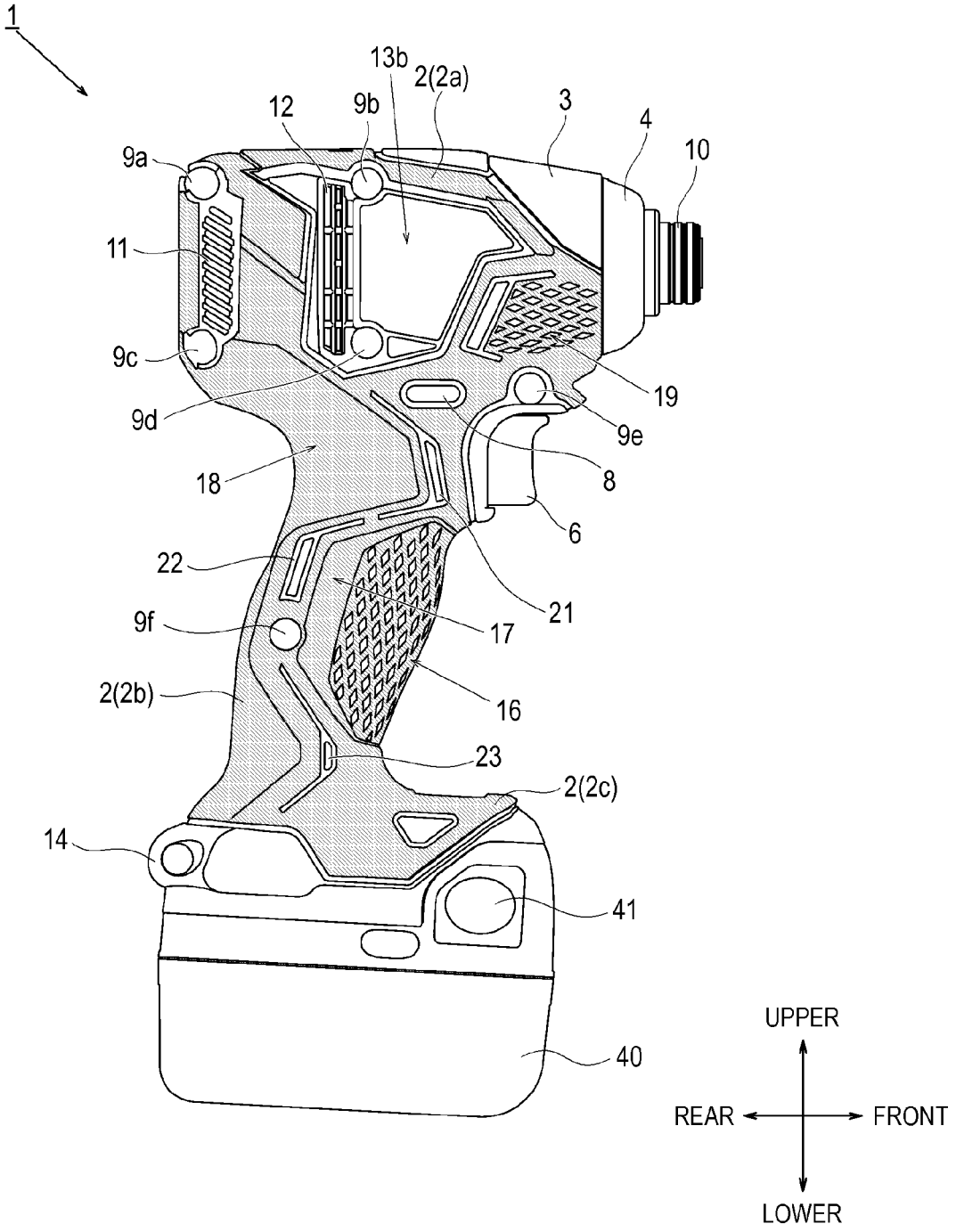
FIG. 2 is a right side view of the impact driver according to the illustrative embodiment of the invention.

FIG. 2 is a right side view of the impact driver 1 according to the illustrative embodiment of the invention. In FIG. 2, the soft layer made of the elastomer and the like formed on the surface of the housing 2 is hatched, which is different from FIG. 1. Since the housing 2 is divided into two left and right parts and the parts are fixed by a plurality of screws (not shown), the right housing 2 is formed with a plurality of screw holes 9*a* to 9*f*. The right housing 2 is basically symmetric to the left housing 2 shown in FIG. 1. The side of the body part 2*a* is formed with the air introduction port 111 and the air discharge port 12. A substantial center of the side of the body part 2*a* is provided with an information plate 13*b* such as a type indication. The soft layer shown with the hatching lines is to prevent a finger of the operator gripping the handle part 2*b* of the housing 2 from sliding and to improve the sense of gripping, thereby improving the operability and workability. The soft layer is formed to cover the substantially entire housing 2. However, since the soft layer is manufactured by the bilayer molding method, it is necessary to provide a line (hereinafter, referred to as 'mold line'), which enables the mold of the first layer to be seen, at a predetermined position of the handle part 2*b* such that the elastomer can be easily separated from the mold upon the molding of the handle grip of the two layers of the mold and the elastomer. In this illustrative embodiment, a mold line 21 is provided near the rear of the trigger 6, a mold line 22 is formed in the vicinity of the substantial center of the handle part 2*b* in the upper-lower direction and the mold line 23 is formed at the lower side of the handle part 2*b*. As can be seen from the comparison with the mold lines shown in FIG. 1, the mold line 21 is bilaterally symmetric but the mold lines 22, 23 are not strictly bilaterally symmetric. The reason that the mold lines 22, 23 are not strictly bilaterally symmetric is to avoid the screw hole 9*f* of the right housing 2. However, from a standpoint of the design idea, the mold lines are bilaterally symmetric. A fingertip abutting part 17 for placing a fingertip thereon is formed between the central front area 16 of the handle part 2*b* and the mold line 22. A shape and the like of the fingertip abutting part 17 will be described later.

Figure 3:
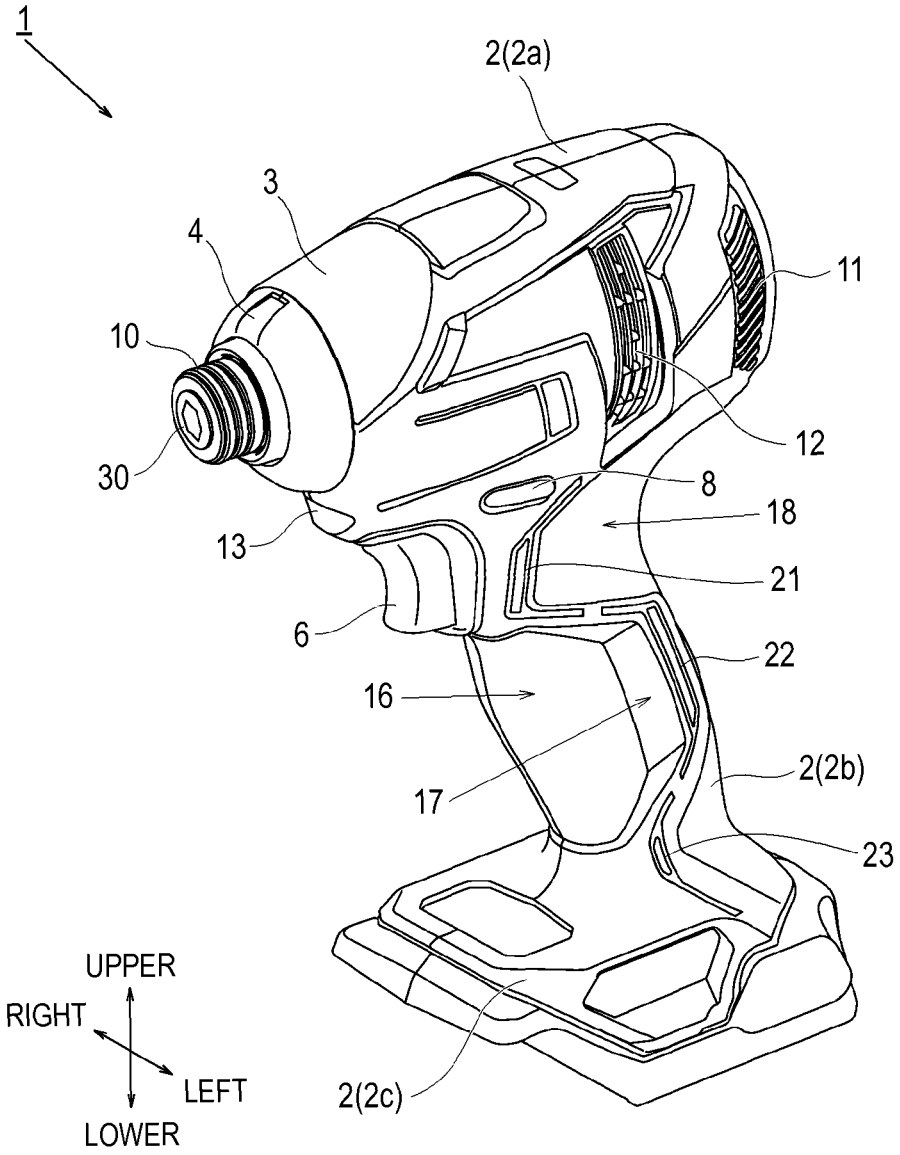
FIG. 3 is a perspective view showing a shape of a housing 2 of the impact driver according to the illustrative embodiment of the invention.

FIG. 3 is a perspective view showing a shape of the housing 2 of the impact driver 1 according to the illustrative embodiment of the invention. In this illustrative embodiment, the shape of the handle part 2*b* is characterized, and the handle part 2*b* is formed with a convex shape conforming to the concave and convex of the palm. The main part of the mold line 22 having the convex shape is located at the rear of the center, when seen from the front-rear direction, and the substantially rectangular fingertip abutting part 17 is formed at the front of the vertically extending part of the mold line 22. The fingertip abutting part 17 has a shape that is widened such that a rear side more protrudes than a front side (so that the left-right width is thickened), in other words, the fingertip abutting part 17 has an inclined surface of one side of a mountain, and the mold line 22 is located at the top of the inclined surface. The fingertip abutting part 17 functions as a finger placing surface holding the fingertip. Since the central front area 16 at the front of the fingertip abutting part 17 is not formed with a large convex part, except for the sliding prevention processing, it is possible to implement the handle part 2*b* that can be easily gripped. On the other hand, an upper part of the central front area 16 that is an area in which the middle to little fingers are held is formed with an upper-rear area 18 becoming a thumb area for holding the thumb and is formed such that it forms a curved surface continuing from a rear side thereof to a vicinity of the rear side of the trigger 6. The mold line 21 is formed between the trigger 6 and the upper-rear area 18. However, since the mold line 21 is formed just at the rear of the part from which the trigger 6 protrudes, the fingertip does not contact the mold line when the operator grips the trigger with the index finger. Also, seeing the palm side (the right side surface of the handle part), since the mold line 22 is provided to a position so as to have a positional relation such that the recessed portion of the palm (the portion at which a head line is located and which is located near the hand circumference that is measured when measuring a glove size) is matched with the mold line 22, it is possible to implement the handle part 2*b* that the operator can easily grip and is not tired well.

Figure 4:
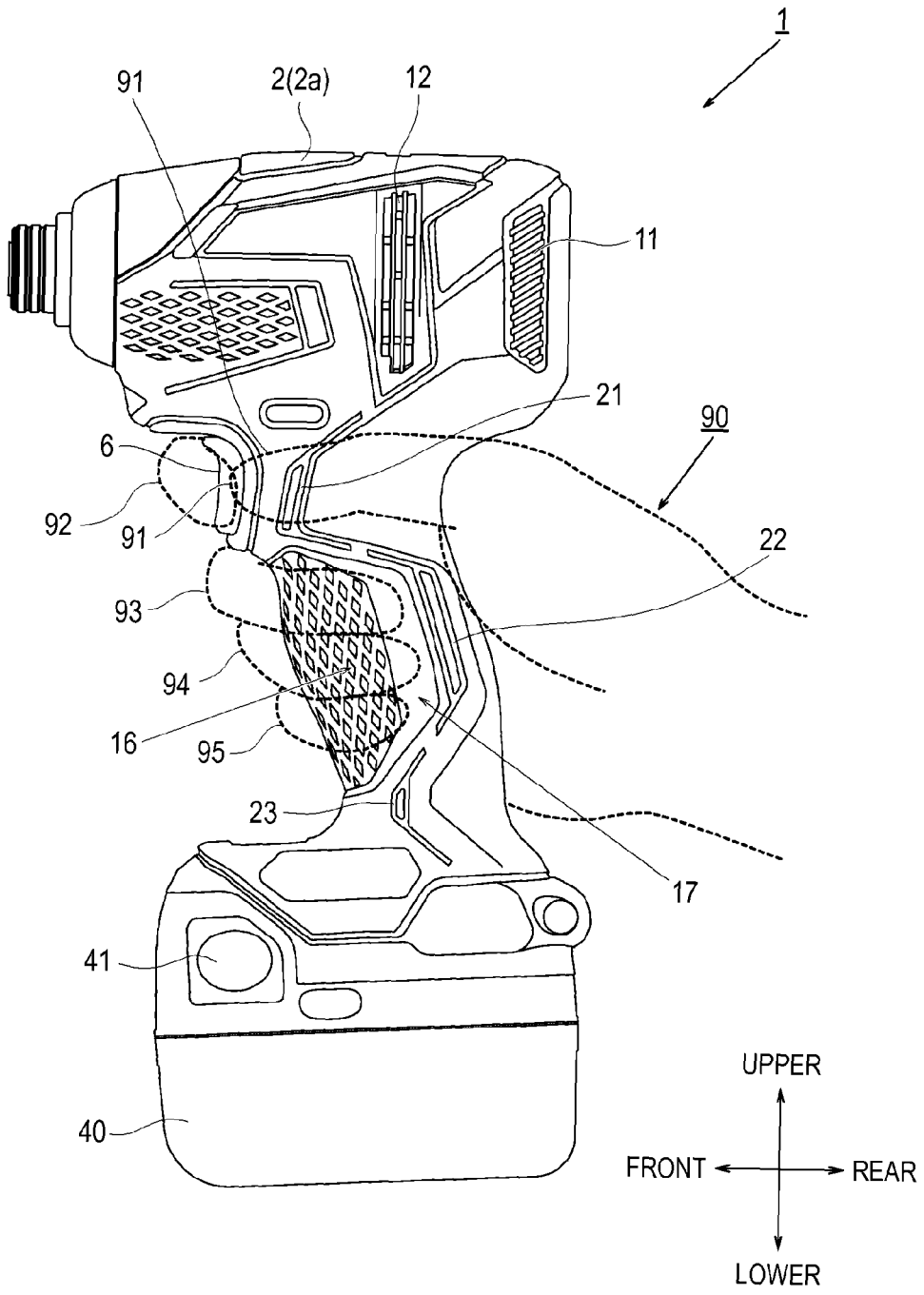
FIG. 4 is a left side view showing a first grip state of the impact driver according to the illustrative embodiment of the invention.

FIG. 4 is a left side view showing a first grip state of the impact driver 1 according to the illustrative embodiment of the invention. This gripping method is a standard method. For example, the operator touches the trigger 6 with the index finger 6 of right hand and turns on/off the trigger 6 with the index finger with gripping the handle part 2*b* of the housing 2 by the remaining fingers. The trigger 6 is moved back and forth upon the on/off operation. The trigger 6 has an operation surface having a recess shape, when seen from the side. At this time, the thumb 91 grips the rear side of the trigger 6 and a central portion of the tip of the first joint of the thumb 91 is contacted onto the mold line 21. However, the central portion is just lightly contacted to the mold line 21 and the tip of the first joint does not strongly press the handle part 2*b*. Thus, even when the mold line 21 is located at the corresponding position, any operational problem is not caused.

On the other hand, a middle finger 93, a ring finger 94 and a little finger 95 are positioned to follow the central front area 16 becoming a middle to little fingers area and the fingertips of the middle finger 93, the ring finger 94 and the little finger 95 favorably abut on the fingertip abutting part 17. At this positional relation, since the fingertip abutting part 17 is formed as the inclined surface that is convex leftwards and rightwards from the front towards the rear, it is possible to implement the handle part 2*b* that the operator can easily grip and is not tired well. As can be seen from FIG. 4, the recess-shaped mold line 21, through which the lower resin of the handle part 2*b* is reflected, is arranged to be a substantial U shape having an opening at the rear side thereof such that it surrounds the periphery of the thumb 91. Also, the mold line 22 is arranged to be a substantial U shape having an opening at the front side thereof such that it surrounds the peripheries of the middle finger 93, the ring finger 94 and the little finger 95. The mold line 23, which is located below the mold line 22, is arranged to be a substantial U shape having an opening at the rear side thereof. The mold lines 21 to 23 are arranged such that a combined shape thereof becomes a substantial W shape, when seen from the side. In this way, in this illustrative embodiment, while using the mold lines 21, 22, 23 necessary for the molding, the positions of the convex portions of the handle part 2*b* are determined, particularly, are arranged to avoid the thumb placing part (18), the grip rear and the index to little fingers wrapping part (16), which are thought to be strongly pressed, and the mold lines 21, 22, 23 are finally arranged to be a substantial W shape such that it is not matched with a central line (refer to FIG. 7) of the handle part. Thereby, it is possible to reduce the stress, which the operator feels when the operator grips the handle part 2*b*, and to expect an effect of increasing the gripping force.

Figure 5:
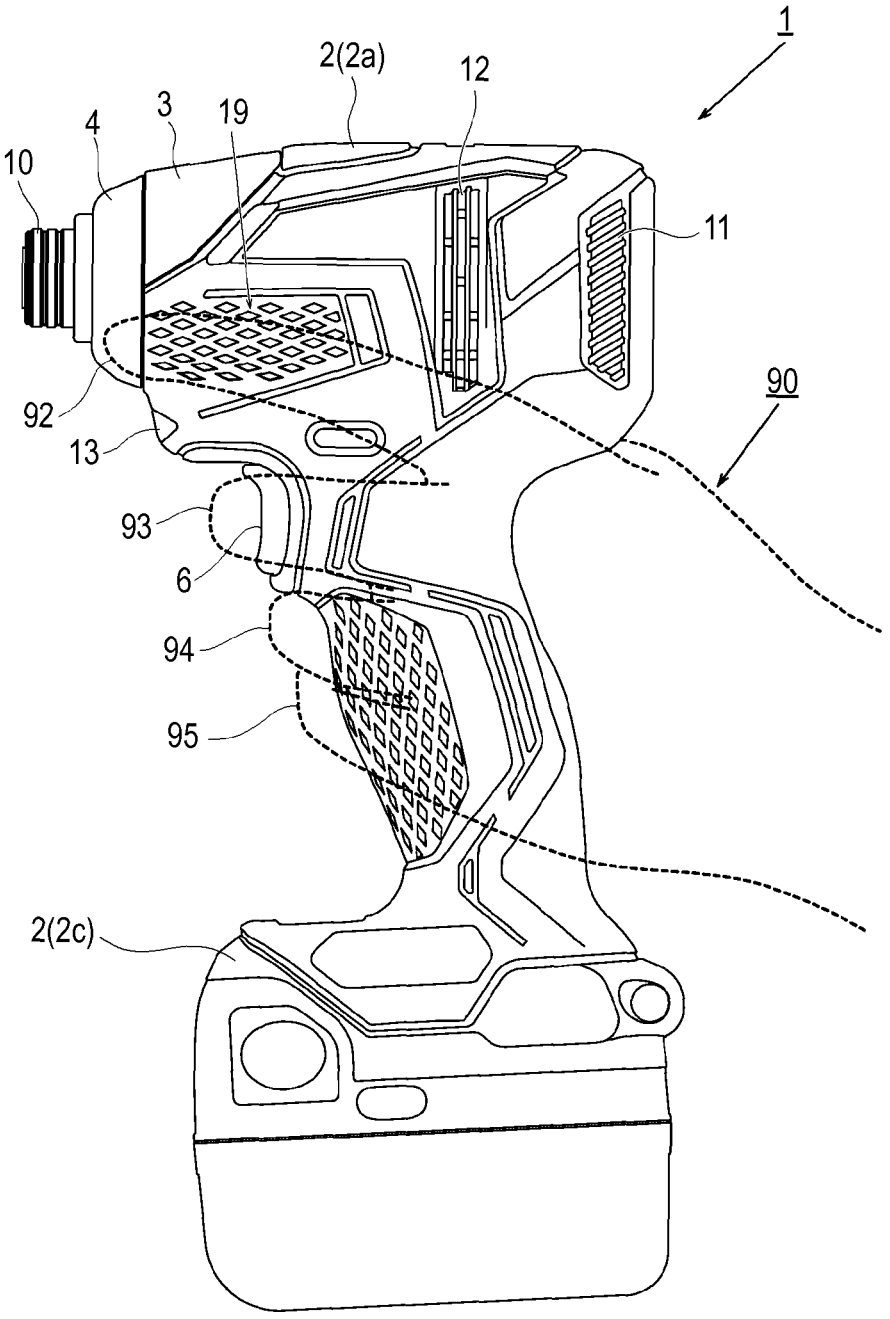
FIG. 5 is a left side view showing a second grip state of the impact driver according to the illustrative embodiment of the invention.

FIG. 5 is a left side view showing a second grip state of the impact driver according to the illustrative embodiment of the invention. In FIG. 5, it is shown for convenience of explanation that the operator grips the handle part 2*b* with the left hand. However, it has no particular meaning, and the case where the operator grips the handle part with the right hand is bilateral symmetrical with the case where the operator grips the handle part with the left hand. The shown gripping method is an atypical gripping method and shows a state where the operator operates the trigger 6 with the middle finger 93 when the operator feels tired at the index finger 92 due to the longtime operation, for example. When performing the trigger operation, the operator typically pulls the trigger with the index finger 92, in many cases, as shown in FIG. 4. For this reason, the handle part 2*b* is made such that the operator can easily perform the trigger operation with the index finger 92. However, the operator may perform the trigger operation with the middle finger 93 due to the operator's habits or fatigue due to the longtime operation. In this case, the index finger 92 requires a place (holding place) for placing the index finger thereon at a position higher than the trigger. However, in such a case, many operators stretch and put the finger (index finger) to and on the adjacency of the body part 2*a* of the housing 2 so as to more stabilize the main body of the tool during the operation. According to the impact driver 1 of this illustrative embodiment, the lower half part of the hammer case 3 is covered with the housing 2, so that the body part 2*a* of the housing 2 is formed with a place (the finger abutting part 19) on which the index finger 92 is put. Also, an end face thereof is covered with the elastomer material, so that the gripping property is improved in a range within which the index finger is contacted. By this formation, both the part of the body part 2*a* and the part of the protector 4, to which the index finger 92 is contacted, are formed of the soft and elastic material. Therefore, the tactual sense is improved, the finger is not slid well thereon, and the temperature is not increased well because the thermal conductivity is low. Accordingly, the operator can comfortably perform the operation. Furthermore, the surface of the elastomer material is formed with the concave and convex, so that the gripping property is improved to enable the finger not to be slid thereon well. Also, when changing the trigger operation from the index finger 92 to the middle finger 93, even though the ring finger 94 and the little finger 95 are moved to the upper of the central front area 16, the fingertips of the ring and little fingers are well contacted to the fingertip abutting part 17.

Figure 6A:
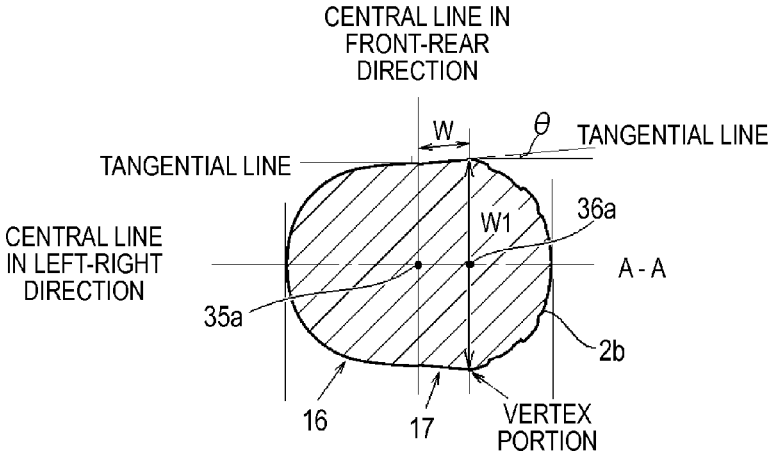
Figure 6B:
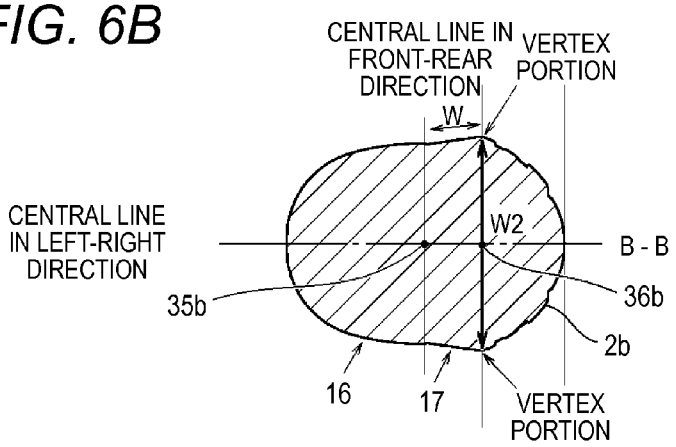
Figure 6C:
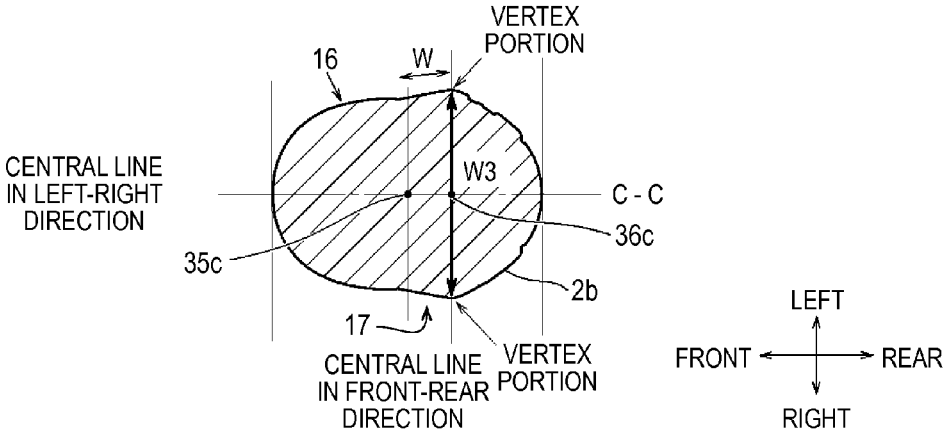

FIG. 6 is a sectional view for illustrating sectional shapes of the handle part 2*b* perpendicular to the axial direction, in which FIG. 6A is an A-A sectional view of FIG. 1, FIG. 6B is a B-B sectional view of FIG. 1 and FIG. 6C is a C-C sectional view of FIG. 1. The side surface of the handle part 2*b* is configured such that the convex shapes (the mold lines 21 to 23) conforming to the shape of the operator's palm are added to improve the sense of fitting upon the gripping, the range in which the middle, ring and little fingers are wrapped is formed as the central front area 16, and the inclined surface part (the fingertip abutting part 17) is formed from the central axis of the handle part towards the rear. A connection part between the central front area 16 and the fingertip abutting part 17 may be separated by a small recess (a recessed portion) such that a boundary thereof is clearly formed. A width W of the fingertip abutting part 17 in the front-rear direction is about 8.8 mm and an inclined angle θ thereof is formed to be about 8° by chamfering processing. Here, the fingertip abutting part 17 is arranged at the rear of the central line in the front-rear direction at the central part of the handle part in the upper-lower direction. The fingertip abutting part 17 is obliquely formed such that the inclination angle θ is set to be about 8° at any position of the A-A to C-C sectional views, the rear widths (W1, W2, W3) are wider than the width passing to the central line of the handle part 2*b* in the front-rear direction, and the maximum width position of the handle part 2*b* is adjacent to the top of the rear end-side of the fingertip abutting part 17. That is, a center 36*a* of a line connecting the tops of both left and right positions of the handle part 2*b* is located at the rear of a central point 35*a* of the handle part 2*b*.

Figure 7:
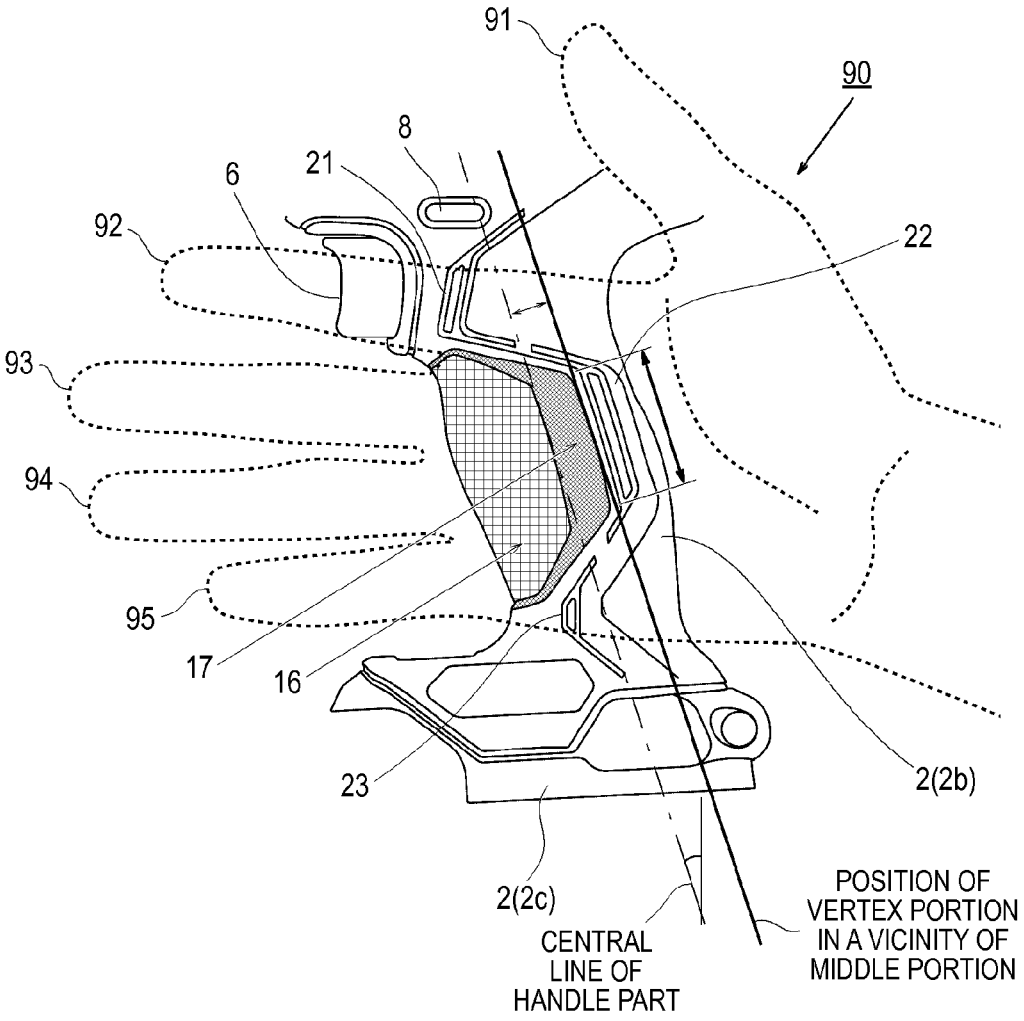
FIG. 7 illustrates an arrangement relation between the handle part 2*b* of FIG. 1 and a hand.

FIG. 7 illustrates an arrangement relation between the handle part 2*b* of FIG. 1 and a hand. Considering the operability and workability of the impact driver 1, the handle part 2*b* of the housing 2 is not at a right angle to the body part 2*a* (the rotating center of the motor) and is formed to be inclined forwards from the right angle by a predetermined angle θ, as shown in FIG. 7. The inclined angle θ is set to be about 8° from the ergonomical standpoint. In this illustrative embodiment, the handle part 2*b* is configured such that the mold line 22 most protruding in the left-right direction is positioned at the rear of the central line of the handle part in the vicinity of the center of the handle part 2*b* in the upper-lower direction, when seen from the side. As can be seen from FIG. 7, since the line indicating the position of the protrusion is substantially matched with the dent portion (the part corresponding to the so-called hand circumference) of the palm of the operator's hand 90, the operator can comfortably grip the handle part. Also, the central front area 16 is positioned in the vicinity of the part ranging from the middle finger 93 to the little finger 95 and the fingertip abutting part 17 is positioned at the rear of the central front area. An upper-lower length H of a front-rear width area of the fingertip abutting part 17 is about 30 mm and the fingertips of the middle, ring and little fingers are enabled to favorably abut on a substantially rectangular area of H (=30 mm) by W (=8.8 mm), so that the sense of touch of the fingertips is made to be smooth.

Figure 8:
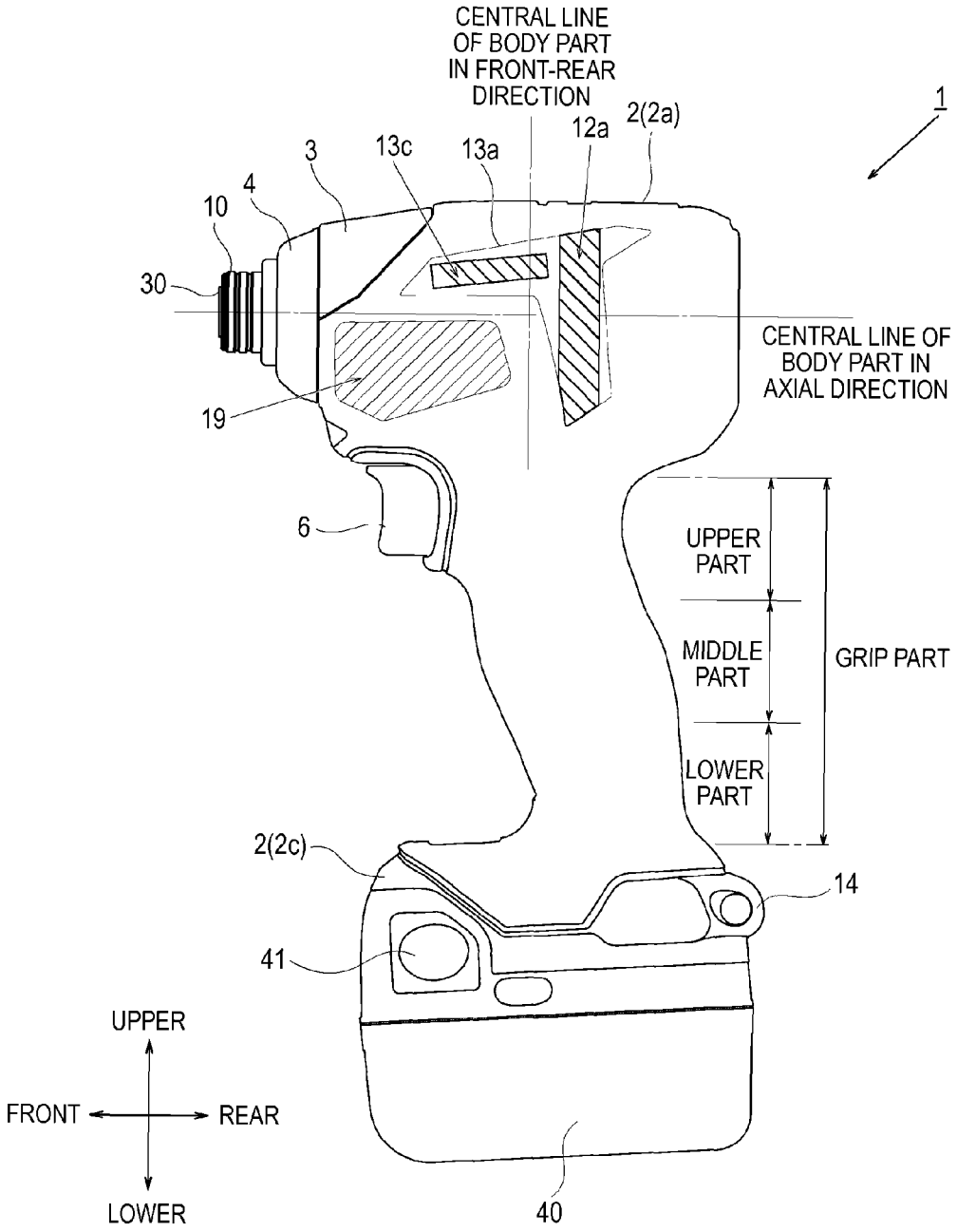
FIG. 8 illustrates a positional relation of a finger abutting part 19 formed on a body part 2*a* of FIG. 1.

FIG. 8 illustrates a positional relation of the finger abutting part 19 formed on the body part 2*a* of the housing 2 of FIG. 1. Here, the finger abutting part 19 is formed at the position that is lower than the central line of the body part in the upper-lower direction, is in front of the central line of the body part in the front-rear direction, and is higher than the trigger 6. In order to provide a trademark indication area 13*c* and a ventilating window 12*a*, a mold pattern 13*a* that is not formed of the elastomer is provided in the vicinity of the center of the body part 2*a* in the front-rear direction. The mold pattern 13*a* is an area in which the hard layer forming the housing 2 is exposed. The handle part 2*b* is gripped by the operator and is equally divided into three parts that are an upper part, a middle part and a lower part in the upper-lower direction. A shape, a thickness, a front-rear length, a left-right width and the like of the handle part are unequally configured from the upper to the lower such that the operator can easily grip the handle part, when seen from the side.

Figure 9:
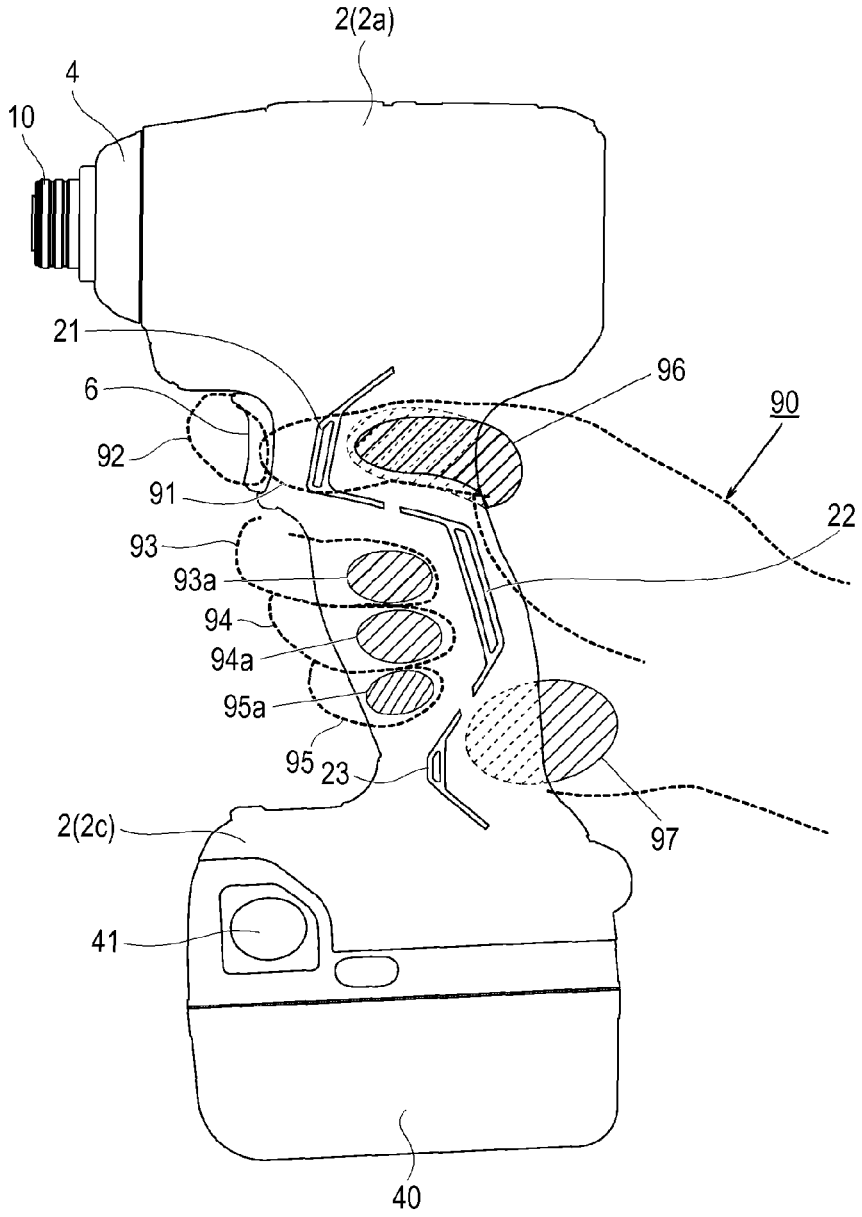
FIG. 9 illustrates a contact relation between the handle part 2*b* of FIG. 1 and a hand 90 when the handle part is gripped.

FIG. 9 illustrates a contact relation between the handle part 2*b* and the hand 90 when the handle part is gripped. Here, paying attention to the arrangement of the mold lines 22, 23, the mold lines 22, 23 on the left side surface are arranged such that they do not overlap with the operator's fingers. The central part of the mold line 21 is located at the front contact part of the first joint of the thumb. However, the contact part does not strongly apply the force and the force is applied by a rear area (a finger crotch part 96) thereof. Therefore, even when the mold line 21 is arranged as described above, any inconvenience is not caused. Also, the area (the finger crotch part 96) is located at the part in which the mold line 21 is sandwiched, so that the operator can easily apply the force and is not tired well even during the longtime operation. A hypothenar 97 of the hand 90 also can easily apply the force. Here, since the mold line 23 is arranged to surround the periphery of an area to which the hypothenar 97 is contacted, at the lower of the handle part 2*b*, the contact area of the hypothenar 97 is contacted to the smooth part formed of the elastomer.

Furthermore, the protrusion part by the right mold line 23 is substantially matched with the dent portion (the part following the hand circumference) of the operator's palm. Hence, it is possible to make the handle part 2*b* that the operator can easily get used to the mold line 23 and is not tired well.

Figure 10:
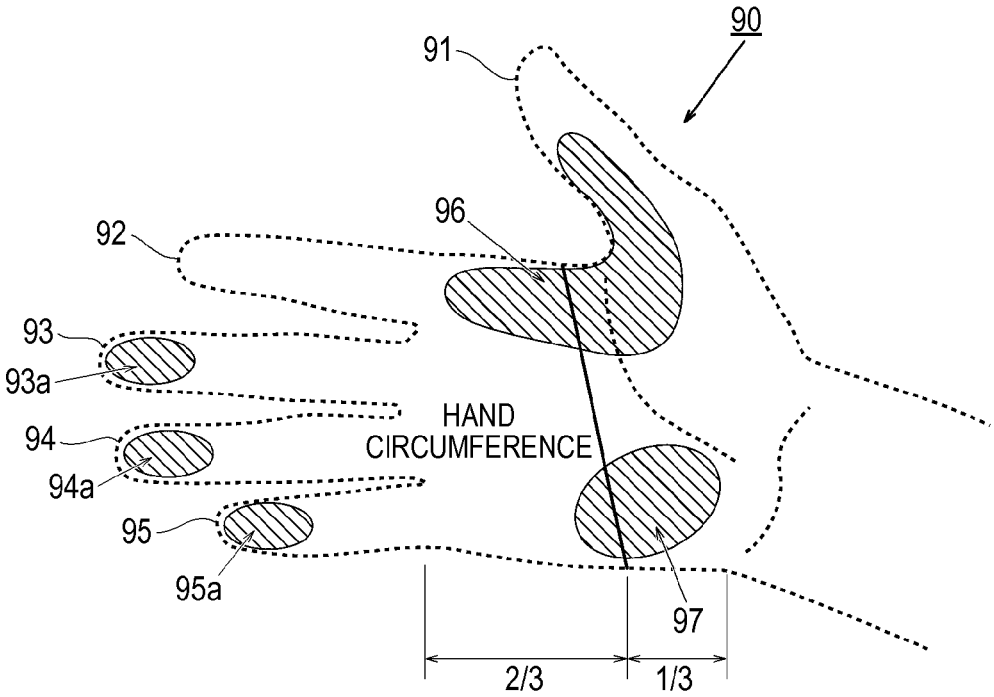
FIG. 10 illustrates an operator's right hand.

FIG. 10 illustrates the operator's right hand. The part that easily applies the force when gripping the handle part 2*b* is a fingertip 93*a* of the middle finger 93, a fingertip 94*a* of the ring finger 94 and a fingertip 95*a* of the little finger 95. In addition, the finger crotch part 96 and the hypothenar 97 can also easily apply the force. The part of the palm, which is referred to as the hand circumference (the position to which the head line passes), is the most dented portion. However, when the corresponding part is formed in conformity to the position of the mold line 22, the sense of holding is better when gripping the handle part 2*b*. Incidentally, the part referred to as the hand circumference is a circumference of the palm connecting a starting point of a life line located at the substantially same position as the first joint of the thumb and a one third distance from the wrist of a line connecting the root of the little finger and the wrist.

Figure 11:
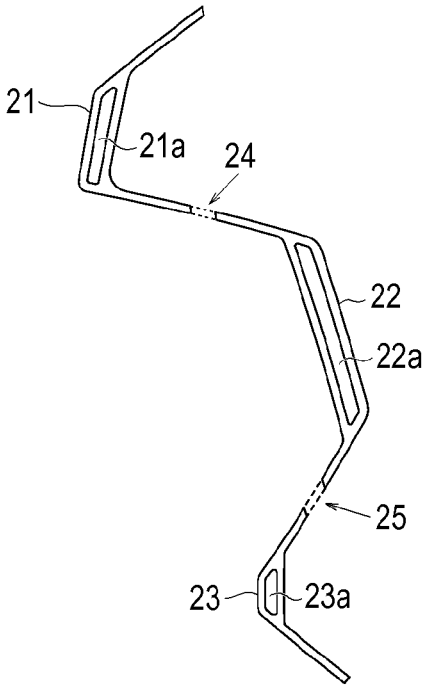
FIG. 11 illustrates shapes of mold lines of FIG. 1.

FIG. 11 illustrates the shapes of the mold lines 21 to 23. The mold line 21 is the U-shaped line having an opening directed towards the rear, when seen from the side, the mold line 22 is the U-shaped line having an opening directed towards the front, when seen from the side, and the mold line 23 is the U-shaped line having an opening directed towards the rear, when seen from the side. The mold line 22 is arranged at the position surrounding fingertip contact surfaces of the middle finger 93, the ring finger 94 and the little finger 95. The fingertip contact surfaces of the middle finger 93, the ring finger 94 and the little finger 95 are parts that especially apply the force upon the gripping. Thus, since the area surrounded by the mold line 22 is elastic and is configured such that the finger is not slid well, the operator can comfortably perform the operation. The mold lines 21 to 23 are formed between the parts on which the soft layer (the elastomer) is formed and are arranged such that the combined shape thereof becomes a substantial W shape, when seen from the side. The connection parts 24, 25 on which the soft layer (the elastomer) is formed are connected so as to increase the fluidity of the elastomer resin, are provided for manufacturing reasons. The connection parts 24, 25 may be configured to connect the three mold lines if there is no manufacturing problem. Also, the central parts of the mold lines 21 to 23 are formed with convex portions 21*a*, 22*a*, 23*a* each of which has a slightly convex lower layer. The convex portions 21*a*, 22*a*, 23*a* are enabled to function as a sliding prevention mechanism of the hand when performing or not performing the operation. Incidentally, the inner areas of the mold lines 21 to 23 may be formed to have a smooth curved surface or plane without forming the convex portions 21*a*, 22*a*, 23*a*.

Second Illustrative Embodiment

Figure 12:
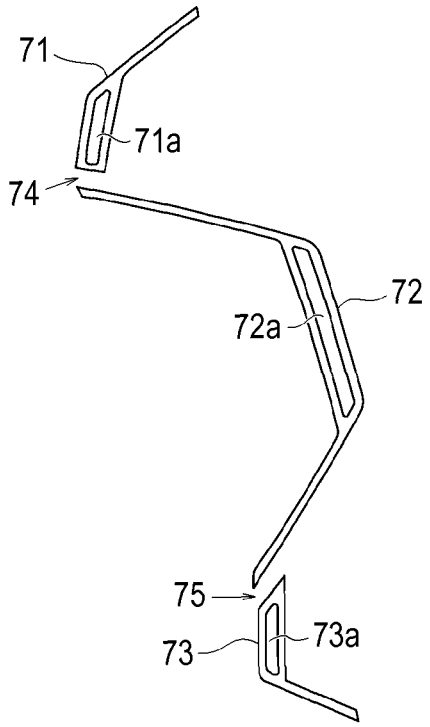
FIG. 12 illustrates shapes of mold lines according to a second illustrative embodiment of the invention.

FIG. 12 illustrates shapes of mold lines 71 to 73 according to a second illustrative embodiment of the invention. In this illustrative embodiment, mold lines that are convex portions protruding from the surface of the handle part 2*b* at least by 2.5 mm are formed on both left and right side surfaces of the handle part 2*b* of the housing 2 such that they follow the longitudinal direction of the handle part 2*b*. The mold lines 71, 73 have a substantial L shape, the mold line 73 is a U-shaped line having an opening directed towards the front, when seen from the side, and these mold lines are arranged such that an arranged shape of these mold lines becomes a substantial W shape, when seen from the side. The central parts of the mold lines 71 to 73 are also formed with convex portions 71*a*, 72*a*, 73*a*. Compared to the first illustrative embodiment, the positions of connection parts 74, 75, on which the soft layer (the elastomer) is formed, are different. The reason to form the convex portions is the same as the first illustrative embodiment. Incidentally, alternative to forming the convex portions to have a step, inner areas of the mold lines may be formed to have the slight concave and convex or a smooth curved surface or plane.

As described above, according to the invention, the convex recessing formed on the handle part 2*b* is made to be deeper than the related art and the end face thereof is largely chamfered, so that the step is removed and the sense of touch of the finger is made to be smoother. Further, the recessing width from the upper to the lower is kept to be the same, so that it is possible to secure the sufficient space and to cope with the change in the grip position in the upper-lower direction. Furthermore, most of the hammer case is covered by the housing, so that it is possible to make a space on which the finger is put. Also, the elastomer material covers up to the end face, so that it is possible to expect the improvements on the gripping force.

Although the invention has been described with reference to the illustrative embodiments, the invention is not limited to the above-described illustrative embodiments and can be variously changed without departing from the scope of the invention. For example, in the above illustrative embodiments, the invention is applied to the cordless impact driver having a chargeable battery. However, the invention can be also applied to an impact driver having a cord. Also, in the above illustrative embodiments, the impact driver has been described as an example of the power tool. However, the invention is not limited to the impact driver and can be also applied to handle parts of other power tools such as a driver drill, a vibration drill, a round saw, a disc grinder and the like.

According to a first illustrative aspect of the invention, there is provided a power tool comprising: a housing comprising; a body part that has a substantially cylindrical shape and extends in a front-rear direction; and a handle part that is connected to the body part, wherein the body part comprises: a driving source; a power transmission mechanism part configured to transmit a driving force of the driving source; and a tip tool holding part to which the driving force of the driving source is transmitted from the power transmission mechanism part, wherein the handle part comprises a switch, wherein a top part protruding from a surface of the handle part is formed on a side surface of the handle part along a longitudinal direction of the handle part, and wherein at least a portion of the top part is arranged at a position deviating rearwards from a center of the handle part in the front-rear direction.

At this, the soft layer is formed on a substantially entire surface of the handle part.

According to a second illustrative aspect of the invention, in the power tool according to the first illustrative aspect, wherein a front side and a rear side of the side surface of the handle part with respect to a central plane between the front side and the rear side passing through a central axis of the handle part are connected by a substantially planar part having different inclined angles.

According to a third illustrative aspect of the invention, in the power tool according to the second illustrative aspect, wherein an upper part of the side surface of the handle part is formed with the top part protruding from the surface of the handle part along an oblique direction with respect to a longitudinal direction of the handle part so as to distinguish a thumb area and a middle to little fingers area, in which middle to little fingers are positioned.

According to a fourth illustrative aspect of the invention, in the power tool according to the third illustrative aspect, wherein a planar part at the rear side of the handle part is formed as a finger placing surface having a substantially rectangular shape and extending in an upper-lower direction.

According to a fifth illustrative aspect of the invention, in the power tool according to the second illustrative aspect, wherein a lower part of the side surface of the handle part is formed with the top part protruding from the surface of the handle part along an oblique direction with respect to a longitudinal direction of the handle part such that a middle and little fingers area and a hypothenar area are distinguished.

According to a sixth illustrative aspect of the invention, in the power tool according to the fourth or fifth illustrative aspect, wherein an upper part of the side surface of the handle part is formed with a thumb area that is continuously formed by a covering of an elastic member from a rear-side to a front-side, and wherein a front end portion of the thumb area is formed to extend to a front side of the central plane.

According to a seventh illustrative aspect of the invention, in the power tool according to the sixth illustrative aspect, wherein a central portion of the side surface of the handle part is formed with the middle to little fingers area that is continuously formed by a covering of the elastic member from the rear-side to the front-side, and wherein a front end portion of the thumb area is formed to extend to a rear-side of the central plane.

According to an eighth illustrative aspect of the invention, in the power tool according to the seventh illustrative aspect, wherein the body part is formed with a finger placing area that is continuously formed by the covering of the elastic member, and wherein the finger placing area is formed in a front area of the body part in the front-rear direction and in a lower area of the body part in an upper-lower direction.

According to a ninth illustrative aspect of the invention, there is provided a power tool comprising: a housing comprising: a body part that has a substantially cylindrical shape and extends in a front-rear direction; and a handle part that is connected to the body part, wherein the body part comprises: a driving source; a power transmission mechanism part configured to transmit a driving force of the driving source; and a tip tool holding part to which the driving force of the driving source is transmitted from the power transmission mechanism part, wherein the handle part comprises a switch, wherein the housing is formed by multilayer molding a hard layer of a synthetic resin and a soft layer softer than the hard layer, wherein the hard layer on a side surface of the handle part is formed with a mold line for molding processing, wherein the mold line has a divided portion and is arranged such that an entire shape thereof becomes a substantial W shape, when seen from a side surface, and wherein one or two places of three places of upper, middle and lower portions of the handle part are formed with U-shaped mold lines that are parts of the W shape.

According to a tenth illustrative aspect of the invention, in the power tool according to the ninth illustrative aspect, wherein the side surface of the handle part is formed with the substantially U-shaped mold line at one of the three places of the upper, middle and lower portions or at the upper and lower portions.

According to an eleventh illustrative aspect of the invention, in the power tool according to the tenth illustrative aspect, wherein the side surface of the handle part is formed with the substantially S-shaped mold line at the upper and middle portions or upper and lower portions of the three places of the upper, middle and lower portions.

According to a twelfth illustrative aspect of the invention, in the power tool according to the eleventh illustrative aspect, wherein the side surface of the handle part is formed with the substantially U-shaped mold line at one of two or three places of the upper, middle and lower portions and with a substantially L-shaped mold line at the remaining place.

According to a thirteenth illustrative aspect of the invention, there is provided a power tool comprising: a housing comprising: a body part that has a substantially cylindrical shape and extends in a front-rear direction; and a handle part that is connected to the body part, wherein the body part comprises: a driving source; a power transmission mechanism part configured to transmit a driving force of the driving source; and a tip tool holding part to which the driving force of the driving source is transmitted from the power transmission mechanism part, wherein the handle part comprises a switch, wherein the housing is formed by multilayer molding a hard layer of a synthetic resin and a soft layer softer than the hard layer, wherein a side surface of the body part is formed with a T-shaped mold pattern, when seen from a side surface on which the soft layer is not formed, and wherein an area for displaying a trademark name and a ventilating window for enabling air to pass therethrough inside and outside the housing are formed in an area of the mold pattern.

According to the first illustrative aspect of the invention, since at least a portion of the top part is arranged at the position deviating rearwards from the center of the handle part in the front-rear direction, the top part is matched with a dent portion of the palm, the gripping is easily made while fingertips of the middle, ring and little fingers are not contacted to the top part, and the finger is prevented from sliding, so that it is possible to implement the handle shape with which an operator is not tired well even during a longtime operation.

According to the second illustrative aspect of the invention, since the front side and the rear side of the side surface of the handle part with respect to the central plane between the front side and the rear side passing through a central axis of the handle part are connected by the substantially planar part having different inclined angles, it is possible to increase the sense of fitting of the fingers, thereby improving the operability and workability.

According to the third illustrative aspect of the invention, since the top part protruding from the surface of the handle part along the oblique direction with respect to the longitudinal direction of the handle part is formed so as to distinguish the thumb area and the middle to little fingers area, it is possible to implement the handle part that can reduce the stress to be applied to the palm when being gripped so that it can be easily gripped.

According to the fourth illustrative aspect of the invention, since the planar part at the rear side of the handle part is formed as the substantially rectangular finger placing surface extending in the upper-lower direction, it is possible to form the handle part to have a shape which can easily stabilize the main body.

According to the fifth illustrative aspect of the invention, since the top part protruding from the surface of the handle part along the oblique direction with respect to the longitudinal direction of the handle part is formed so as to distinguish the middle and little fingers area and the hypothenar area, the tip of the little finger is positioned to follow the top part is difficult to deviate, so that it is possible to form the handle part to have a shape which can easily stabilize the main body.

According to the sixth illustrative aspect of the invention, since the front end portion of the thumb area is formed to extend to the front-side of the central plane, the handle part is favorably contacted to the palm (the root of the thumb) of the operator gripping the handle part, so that the sense of fitting when the operator grips the handle part can be improved.

According to the seventh illustrative aspect of the invention, since the side surface of the handle part is formed at the center thereof with the middle to little fingers area that is continuously formed by the covering of the elastic member from the rear-side to the front-side and the front end portion of the thumb area is formed to extend to the rear-side of the central plane, the sense of fitting when the handle part is gripped with the middle to little fingers can be improved.

According to the eighth illustrative aspect of the invention, the finger placing area that is continuously formed by the covering of the elastic member is formed in the front area of the body part in the front-rear direction and is in the lower area of the body part in the upper-lower direction, so that it is possible to stably maintain the index finger when pulling the trigger with the middle finger.

According to the ninth illustrative aspect of the invention, since one or two places of three places of the upper, middle and lower portions of the handle part are formed with the U-shaped mold lines that are parts of the W shape, it is possible to effectively use the mold lines, which are formed for molding technology reasons so as to easily separate the elastomer from the mold, for improvements on the easy gripping of the handle part.

According to the tenth illustrative aspect of the invention, since the substantially U-shaped mold line is formed at one of the three places of the upper, middle and lower portions or at the upper and lower portions, it is possible to provide the continuous part of elastomer at a substantial center of the three divided parts and to increase the fluidity of the elastomer resin, thereby performing the housing molding with god precision.

According to the eleventh illustrative aspect of the invention, since the substantially S-shaped mold line is formed at the upper and middle portions or upper and lower portions of the three places of the upper, middle and lower portions, it is possible to form the continuous part of elastomer with avoiding the positions at which the fingers are contacted, so that it is possible to manufacture the handle part functionally and gorgeously.

According to the twelfth illustrative aspect of the invention, since the U-shaped mold line is formed at one of two or three places of the upper, middle and lower portions and the L-shaped mold line is formed at the remaining place, it is possible to form the continuous part of elastomer with avoiding the positions at which the fingers are contacted, so that it is possible to manufacture the handle part functionally and gorgeously.

What is claimed is:

1. A power tool comprising:

a housing comprising:

a body part that has a substantially cylindrical shape and extends in a front-rear direction; and a handle part that is connected to the body part, wherein the body part comprises:

a driving source;

a power transmission mechanism part configured to transmit a driving force of the driving source; and a tip tool holding part to which the driving force of the driving source is transmitted from the power transmission mechanism part, wherein the handle part comprises a switch, wherein the housing is formed by multilayer molding a hard layer of a synthetic resin and a soft layer softer than the hard layer, wherein the hard layer on a side surface of the handle part is formed with a mold line for molding processing, wherein the mold line has a divided portion and is arranged such that an entire shape thereof becomes a substantial W shape, when seen from a side surface, and wherein one or two places of three places of upper, middle and lower portions of the handle part are formed with U-shaped mold lines that are parts of the W shape.

2. The power tool according to claim 1, wherein the side surface of the handle part is formed with the substantially U-shaped mold line at one of the three places of the upper, middle and lower portions or at the upper and lower portions.

3. The power tool according to claim 2, wherein the side surface of the handle part is formed with the substantially U-shaped mold line at the upper and middle portions or upper and lower portions of the three places of the upper, middle and lower portions.

4. The power tool according to claim 3, wherein the side surface of the handle part is formed with the substantially U-shaped mold line at one of two or three places of the upper, middle and lower portions and with a substantially L-shaped mold line at the remaining place.

* * * * *